US010364005B2

(12) United States Patent
Harrington et al.

(10) Patent No.: US 10,364,005 B2
(45) Date of Patent: Jul. 30, 2019

(54) DUAL ADJUSTING WATERPROOF SEAL FOR DRYSUITS

(71) Applicant: Ocean Rodeo Sports Inc., Victoria (CA)

(72) Inventors: Ross Davis Harrington, Victoria (CA); Alastair Arthur Wood, Victoria (CA)

(73) Assignee: Ocean Rodeo Sports Inc., Victoria, BC (CA)

( * ) Notice: Subject to any disclaimer, the term of this patent is extended or adjusted under 35 U.S.C. 154(b) by 144 days.

(21) Appl. No.: 15/712,876

(22) Filed: Sep. 22, 2017

(65) Prior Publication Data

US 2018/0086425 A1 Mar. 29, 2018

Related U.S. Application Data

(60) Provisional application No. 62/400,005, filed on Sep. 26, 2016.

(51) Int. Cl.

| | |
|---|---|
| ***B63C 9/13*** | (2006.01) |
| ***B63C 11/04*** | (2006.01) |
| ***A41D 13/012*** | (2006.01) |

(52) U.S. Cl.

CPC ..... *B63C 11/04* (2013.01); *A41D 13/012* (2013.01); *A41D 2300/332* (2013.01); *B63C 2011/043* (2013.01)

(58) Field of Classification Search

CPC ... B63C 11/04; B63C 11/12; B63C 2011/043; B63C 2011/128; B63C 2011/046; B63C 9/087; A41D 13/012; A41D 2300/332; A41D 13/0005; A63B 33/002; A63B 33/00; A42B 1/048; A61F 13/64; A61F 9/027

See application file for complete search history.

(56) References Cited

U.S. PATENT DOCUMENTS

| | | | | | |
|---|---|---|---|---|---|
| 3,710,393 | A * | 1/1973 | Douglas | A61F 9/02 | 128/201.23 |
| 3,755,819 | A * | 9/1973 | Douglas | B63C 11/12 | 2/428 |
| 4,607,398 | A * | 8/1986 | Faulconer | A44B 11/14 | 2/452 |
| 5,191,363 | A * | 3/1993 | Smith | A61F 9/026 | 351/156 |
| 5,630,229 | A * | 5/1997 | Machado | A41D 13/012 | 2/2.15 |

(Continued)

*Primary Examiner* — Robert H Muromoto, Jr.

(74) *Attorney, Agent, or Firm* — Davis & Bujold PLLC; Michael J. Bujold

(57) ABSTRACT

A waterproof seal includes a flexible annular tube formed by an inner layer and an outer layer of a garment and surrounding a passage through which a human appendage is intended to protrude. A first cord is positioned in a cavity defined by the annular tube. The first cord has a first end, a second end and extends more than 180 degrees and less than 360 degrees around the passage with the first end and the second end exiting the annular tube. A second cord is positioned in the cavity defined by the annular tube. The second cord has a first end, a second end and extends more than 180 degrees and less than 360 degrees around the passage with the first end and the second end exiting the annular tube. The first cord and the second cord cumulatively cover more than 360 degrees around the passage to provide an effective water seal.

8 Claims, 9 Drawing Sheets

(56) References Cited

U.S. PATENT DOCUMENTS

| | | | | |
|---|---|---|---|---|
| 6,668,386 | B2 * | 12/2003 | Vidal | A41D 13/0005 2/100 |
| 6,976,894 | B1 * | 12/2005 | Turner | B63C 9/087 405/186 |
| 8,037,547 | B2 * | 10/2011 | Duncan | A62B 17/04 2/202 |
| 9,714,074 | B2 * | 7/2017 | Luomala | B63C 11/04 |
| 2016/0031537 | A1 * | 2/2016 | Luomala | B63C 11/04 24/714.7 |
| 2016/0221649 | A1 * | 8/2016 | Harrington | B63B 35/7993 |
| 2017/0096204 | A1 * | 4/2017 | Cucchia | B63C 11/12 |
| 2018/0086425 | A1 * | 3/2018 | Harrington | A41D 13/012 |
| 2018/0333305 | A1 * | 11/2018 | Bennett | A61F 13/148 |

* cited by examiner

DUAL ADJUSTING WATERPROOF SEAL FOR DRYSUITS

FIELD

There is described a waterproof seal that is positioned around the neck, wrist openings, and ankle openings of a drysuit.

BACKGROUND

Waterproof seals are placed around the neck opening, wrist openings and ankle openings of a drysuit in order to limit, if not stop entirely, leakage of water into the drysuit. U.S. Pat. No. 6,668,386 (Vidal) describes a waterproof seal that includes an annular flexible tube forming part of a garment and surrounding a passage through which said appendage is intended to protrude. A cord is positioned in this annular tube. The cord extends for more than 360 degrees, so that the cord more than completely encircles the passage. A waterproof seal that provides an alternative to Vidal is U.S. Pat. No. 9,714,074 (Luomala et al).

SUMMARY

There is provided a dual adjusting waterproof seal for drysuits that provides an alternative to the waterproof seal of Vidal. This waterproof seal uses two cords each of which extend more than 180 degrees and less than 360 degrees around the passage, while cumulatively extending more than 360 degrees. There are advantages in using two cords, as will hereinafter be described.

The waterproof seal includes a flexible annular tube formed by an inner layer and an outer layer of a garment and surrounding a passage through which a human appendage is intended to protrude. A first cord is positioned in a cavity defined by the annular tube. The first cord has a first end, a second end and extends more than 180 degrees and less than 360 degrees around the passage with the first end and the second end exiting the annular tube. A second cord is positioned in the cavity defined by the annular tube. The second cord has a first end, a second end and extends more than 180 degrees and less than 360 degrees around the passage with the first end and the second end exiting the annular tube. The first cord and the second cord cumulatively cover more than 360 degrees around the passage to provide an effective water seal.

In order to retain the ends of the cords, cord retainers are provided. Preferably, this includes a first cord retainer positioned exterior of the annular tube and engaging the first cord in the vicinity of the first end and a second cord retainer positioned exterior of the annular tube and engaging the first cord in the vicinity of the second end. One of the first cord retainer and the second cord retainer must be capable of repositioning to a selected position along the first cord, for the purpose of adjusting the length of the first cord. Similarly, this should include a third cord retainer positioned exterior of the annular tube and engaging the second cord in the vicinity of the first end and a fourth cord retainer positioned exterior of the annular tube and engaging the second cord in the vicinity of the second end. One of the third cord retainer and the fourth cord retainer must be capable of repositioning to a selected position along the second cord, for the purpose of adjusting the length of the second cord.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

A first embodiment of waterproof seal will now be described with reference to FIG. 1 through FIG. 6. A second embodiment will then be described with reference to FIG. 7. A third embodiment will then be described with reference to FIG. 8 and FIG. 9.

Figure 1:
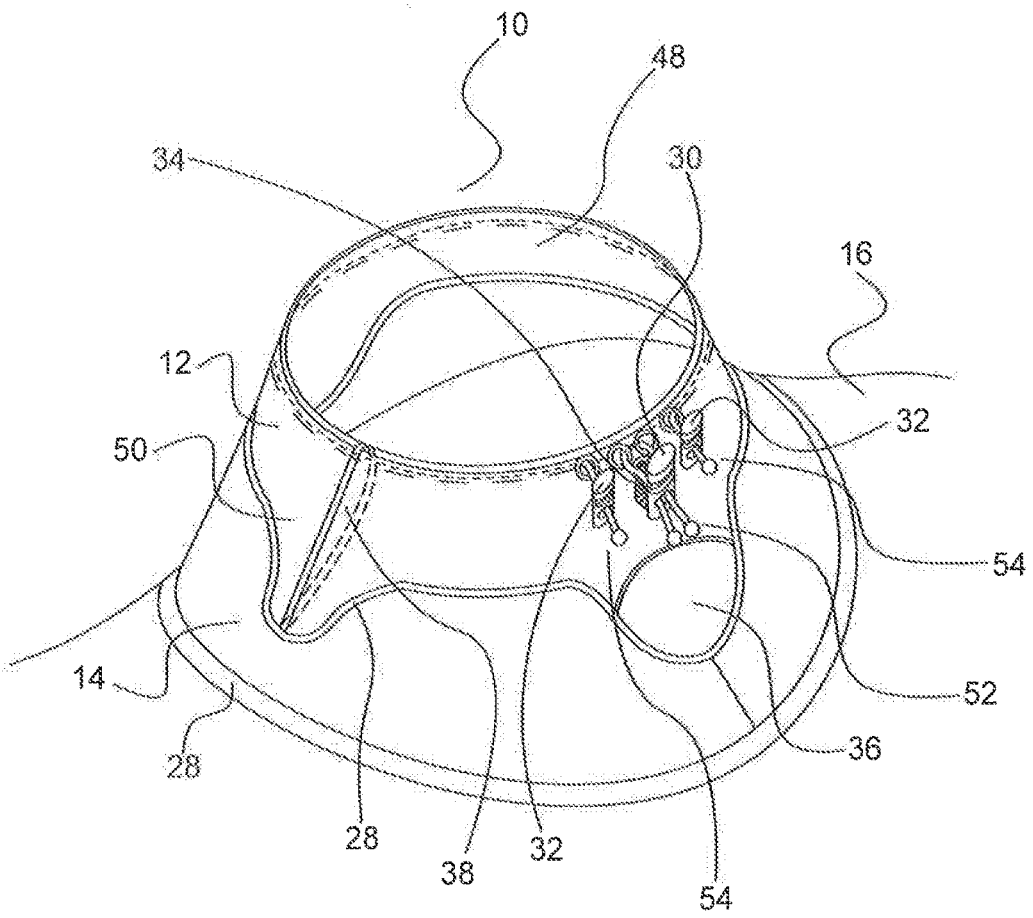
FIG. 1 is a perspective view of a waterproof seal for sealing around the neck, wrists, and ankles of a drysuit.

Structure and Relationship of Parts:

FIG. 1 shows the first embodiment 10 being applied to seal the neck of a drysuit 16. The seal is comprised of an upper portion 12, and a lower portion 14. The upper portion 12 can be made using neoprene or any waterproof material with stretchable characteristics. The lower portion 14 can be made using any waterproof material or fabric. A waterproof seam 28 is used to connect the upper portion 12 to the lower portion 14 and to connect the lower portion 14 to the suit 16.

The upper portion of the seal 12 is comprised of an inner layer 48 and an outer layer 50, which are made when a stretchable waterproof material is folded over to create a cavity 38. Attached to the upper portion 12, are one central major buckle 30 and two or more minor buckles 32 located on either side of major buckle 30. The major buckle 30 has two cord ports and the minor buckles 32 have one port each. The buckles are tethered to the seal using a buckle tether 34. There are multiple buckles to facilitate two or more different seal tightening systems; the major cord adjustment system 52 and the minor cord adjustment system 54. The seal is tightened and loosened by adjusting the length of a first cord 40 and a second cord 42 which are routed inside the cavity 38. The major cord adjustment system 52, is comprised of a major buckle 30, and as first cord 40 and a second cord 42. Because the major buckle 30 has two cords routed through it, it is used to make larger sealing and unsealing adjustments. The minor cord adjustment system is comprised of the minor buckles 32, and first cord 40 and second cord 42. The minor buckles 32 only have 1 cord running through them; therefore the minor cord adjustment system 54 can be used to make smaller adjustments for comfort. The first cord 40 and second cord 42 can be made using shock cord material or any adequately strong elastic cord. However, it is possible to make one cord from non-stretchable materials, provided that the other cord(s) are elastic. The cavity is accessible through an access port 36 located below the major and minor buckles 30, 32 at the front of the seal. This allows the user to replace or repair damaged cords.

Figure 2:
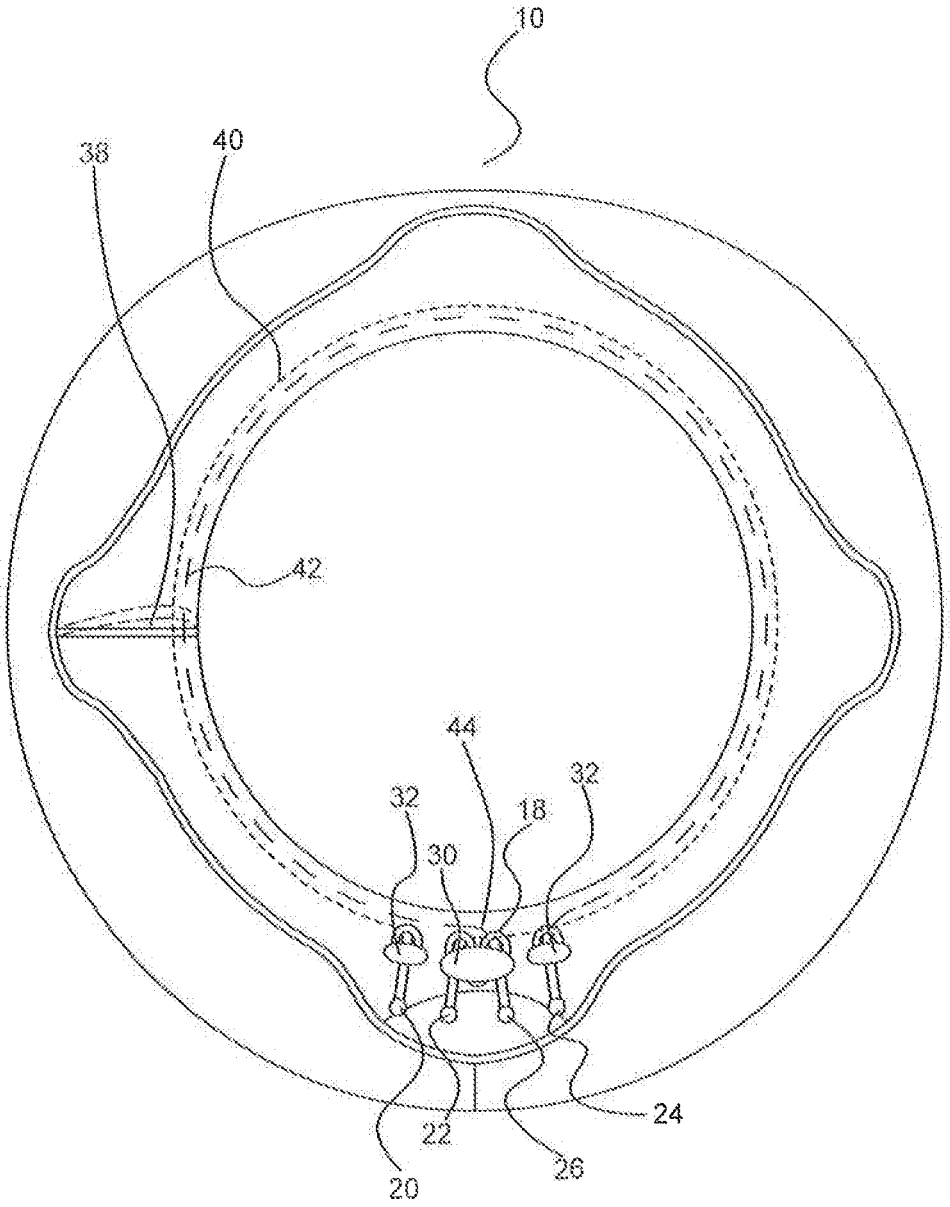
FIG. 2 is a top view of the waterproof seal of FIG. 1.

FIG. 2 shows first embodiment 10 with a clear view of the cord routing. First cord 40 is routed so that the first end 20 exits the cavity 38 through a grommet 18 and then through a minor buckle 32. First cord 40's second end 22 exits the cavity 38 through a grommet 18 which is located more than 180 degrees, but less than 360 degrees away from the exit position of first cord 40's first end 20 along the circumference of the seal. First cord 40's second end 22 then passes through one port of the major buckle 30.

Second cord 42 is routed so that second cord 42's first end 24 exits the cavity through a grommet 18 and then through the other minor buckle 32. Second cord 42's second end 26 exits the cavity through a grommet 18 which is located more than 180 degrees, but less than 360 degrees away from the exit position of second cord 42's first end 24 along the circumference of the seal. This creates a cord overlap location 44. Because the cords are overlapping, there is now tension around the full circumference of the seal. Second cord 42's second end 26 then passes through one port of the major buckle 30. The angular difference between the respective exit locations of first cord 40 and second 42 from the cavity 38 in this embodiment is roughly 350 degrees. However, cumulatively, first cord 40 and second cord 42 cover move than 360 degrees.

Buckles have been shown as cord retainers. It will be understood that anything that retains the first cord 40 or second cord 42 in the vicinity of their respective first ends 20 and 24 or respective second ends 22 and 26 is considered a cord retainer. In first embodiment 10, there is a first cord retainer engaging first end 20 of first cord 40, a second cord retainer engaging second end 22 of first cord 40, a third cord retainer engaging first end 24 of second cord 42 and a fourth cord retainer engaging second end 26 of second cord 42. Major buckle 30 has two ports, which serve as the second cord retainer and the fourth cord retainer. Minor buckle 32 with a single port serve as the first cord retainer and the third cord retainer. It will be appreciated, that instead of major buckle 20 with two ports, two minor buckles with single ports could have been used. Furthermore, instead of using minor buckles as cord retainers, first cord 40 and second cord 42's first ends, 20 and 24 respectively, can also be fixed in place with different cord retainers, such as a knot or plastic component, located on the exterior of the seal. Also, the opposite is possible; instead of using a major buckle as a cord retainer, cord ends 22 and 26 can be fixed in place with two separate cord retainers, such as a knot or plastic component.

Figure 3:
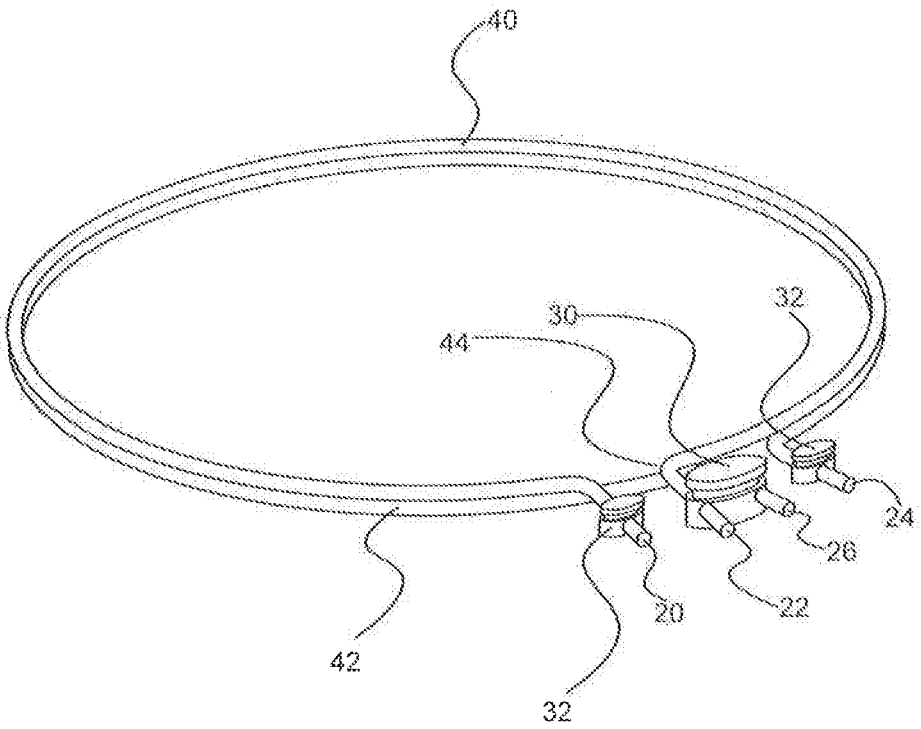
FIG. 3 is a perspective view of the cords for the waterproof seal of FIG. 1.

FIG. 3 shows the cord routing with the upper portion 12, and the lower portion 14 removed. This provides a clear view of first cord 40 and second cord 42 and shows how tensioning of the seal can be achieved over 360 degrees. It also provides a clearer view of the overlap location 44.

Figure 4:
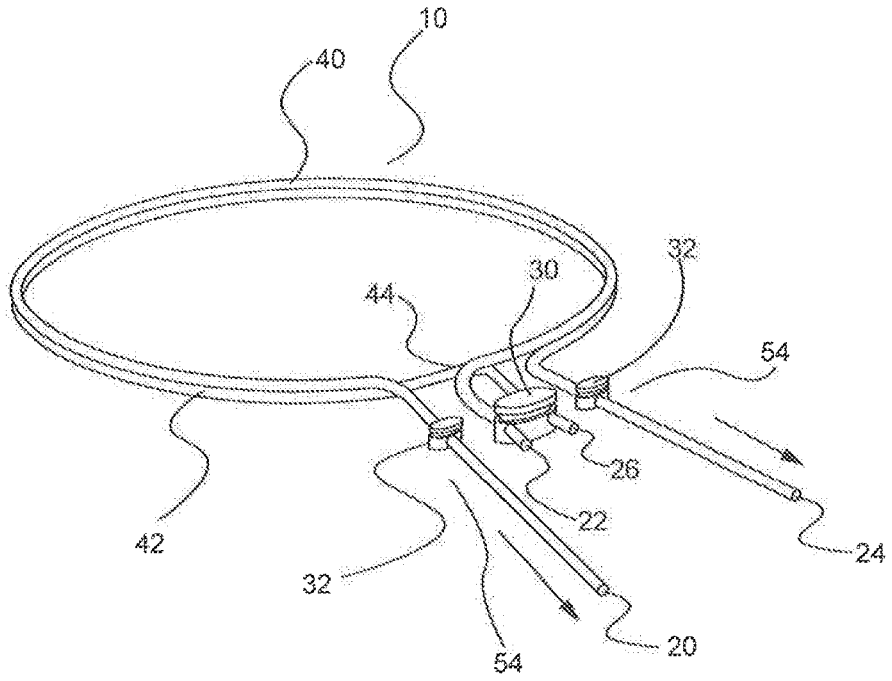
FIG. 4 is a perspective view of the cords of FIG. 2 being tightened using a minor cord adjustment system.

FIG. 4 shows first embodiment 10 being tightened using the minor cord adjustment system 54. This system is used to set the desired level of tightness for the seal so that it is tailored directly to the body of the individual user. It is intended to be used as the micro-adjustment system for the seal. In order to make an adjustment, one can pull on first end 20 of first cord 40 or first end 24 of second cord 42.

Figure 5:
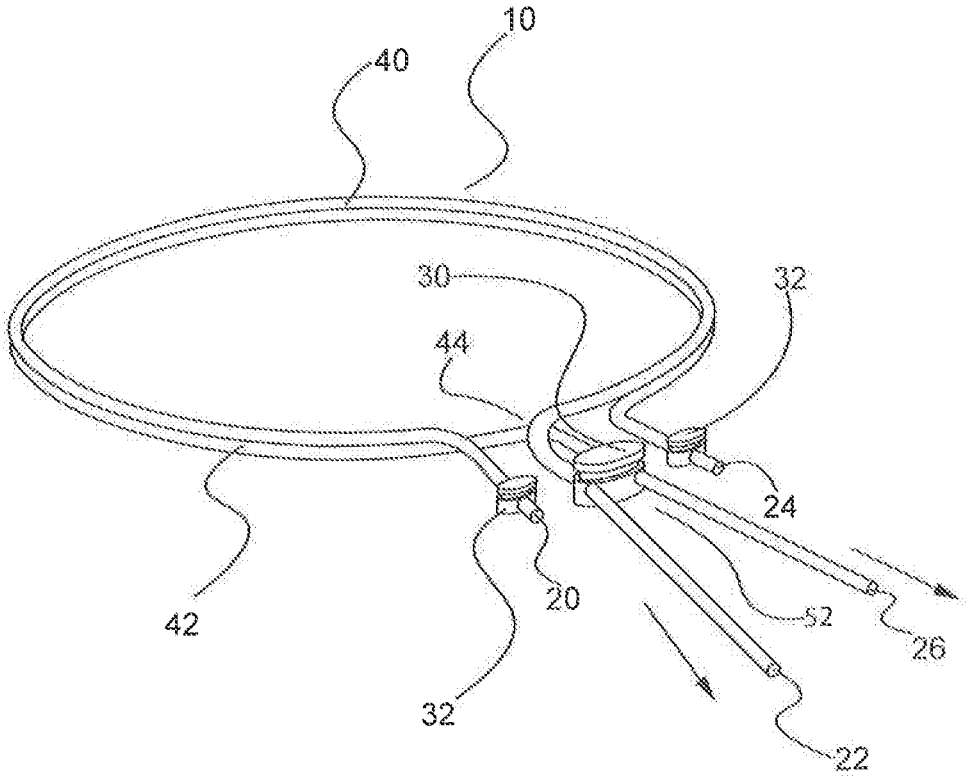
FIG. 5 is a perspective view of the cords of FIG. 2 tightened using a major cord adjustment system.

FIG. 5 shows first embodiment 10 being tightened using the major cord adjustment system 52. This system is used to activate and deactivate the seal. It is intended to be used as the macro-adjustment system for the seal. In order to make an adjustment, one would normally pull on both second end 22 of first cord 40 and second end 26 of second cord 42.

Figure 6:
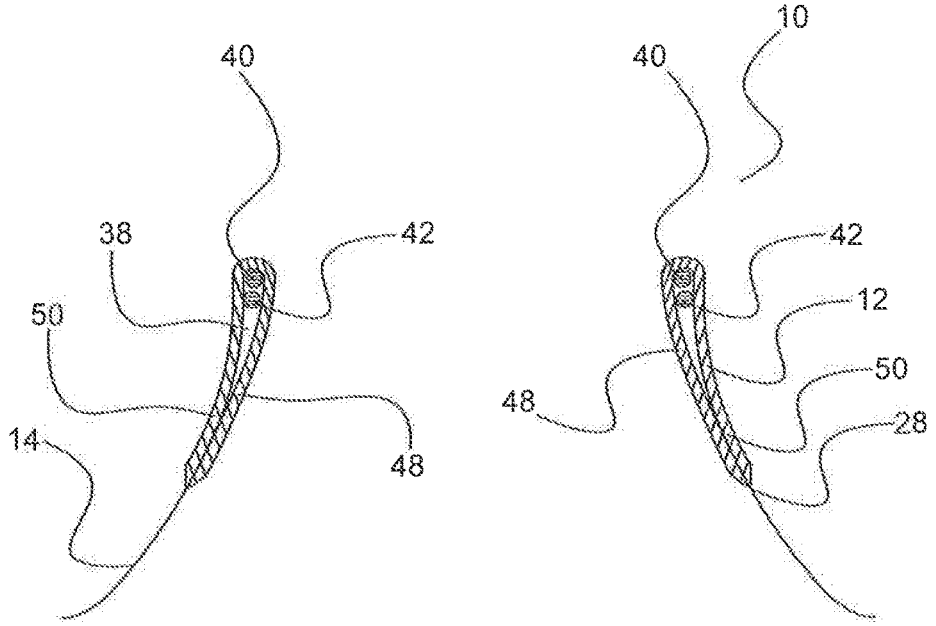
FIG. 6 is a section view of the waterproof seal of FIG. 1.

FIG. 6 shows the upper portion 12 and lower portion 14 of the seal. It shows a clear section view of the cavity 38 that is created between inner layer 48 and outer layer 50. First cords 40 and second cord 42 are shown in their locations inside of the cavity 38.

Figure 7:
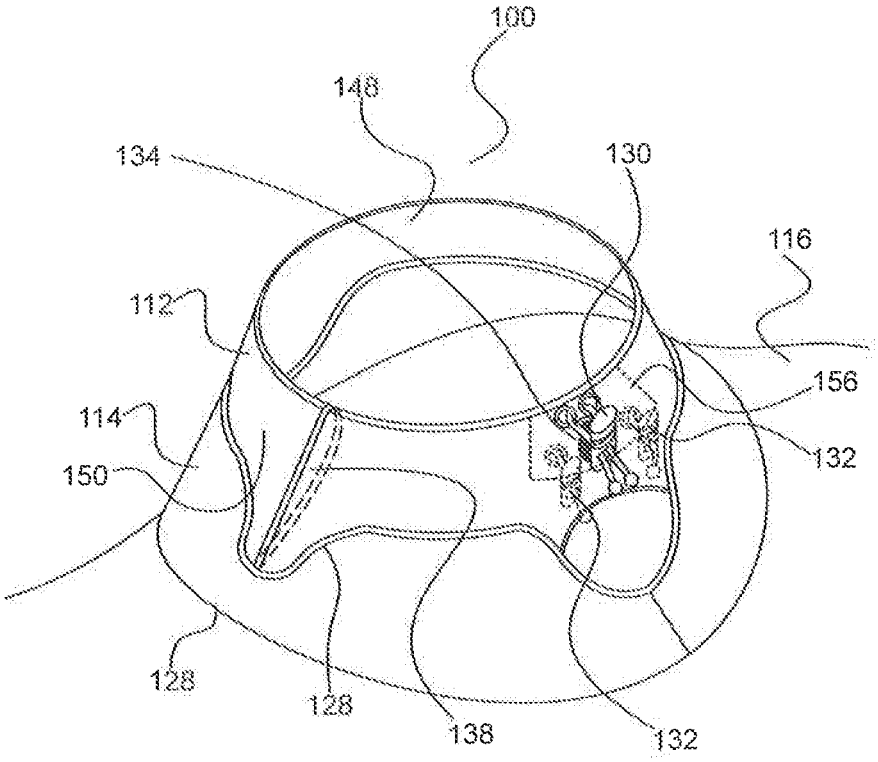
FIG. 7 is a perspective view of a second embodiment of the waterproof seal with the minor adjustment system hidden underneath an exterior shell.

Variations:

FIG. 7 shows a second embodiment being applied to seal the neck of a drysuit 116. The second embodiment is provided to demonstrate that all of the cord retainers need not be exterior of the annular tube and accessible for purposes of adjustment. The seal is comprised of an upper portion 112, and a lower portion 114. The upper portion 112 can be made using neoprene or any waterproof material with stretchable characteristics. The lower portion 114 can be made using any waterproof material or fabric. A waterproof seam 128 that is sewn and seam taped is used to connect the upper portion 112 to the lower portion 114 and to connect the lower portion 114 to the suit 116.

The upper portion of the seal 112 is comprised of an inner layer 148 and an outer layer 150, which are made when a stretchable waterproof material is folded over to create a cavity 138. Attached to the exterior surface of the outer layer of the upper portion 150, is one central major buckle 130. Two minor buckles 132 are located on either side of the major buckle 130, but are hidden underneath the outer layer of the upper portion 150. The minor buckles 132 are attached to an interior buckle panel 156 which is sewn to the interior surface of the outer layer of the upper portion 150. This prevents confusion when attempting to tighten or loosen the seal. The major buckle 130 has two cord ports and the minor buckles 132 each have one port. The major buckle 130 is tethered to the seal using a buckle tether 134.

Figure 8:
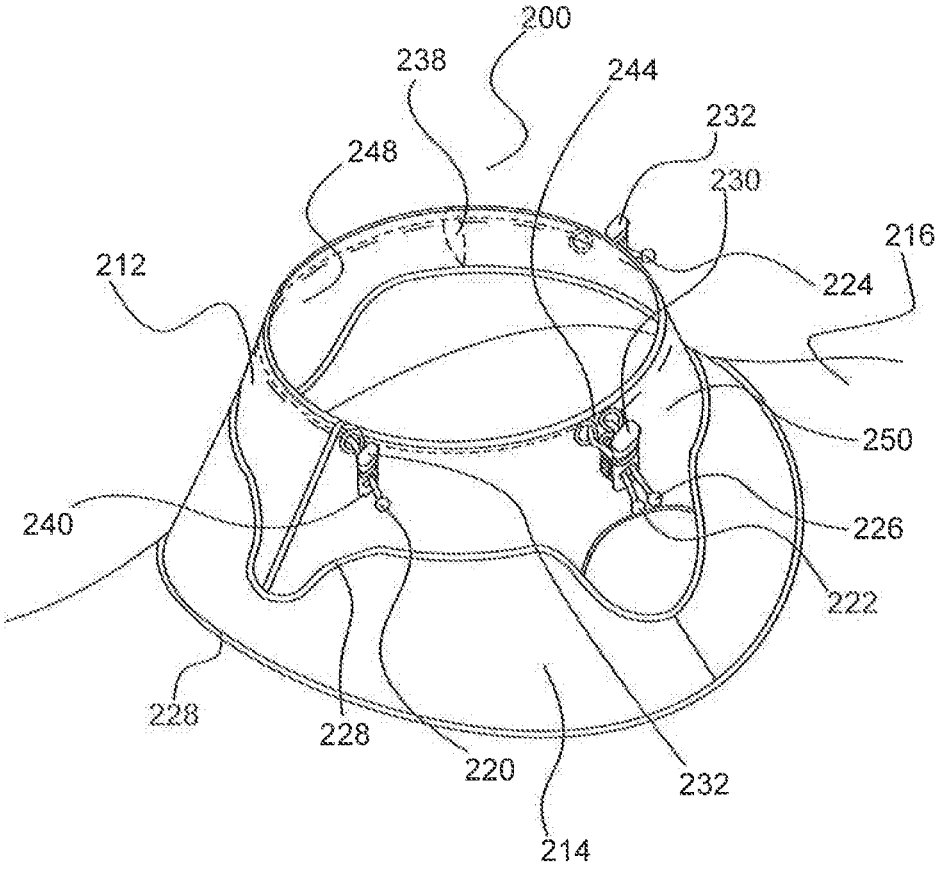
FIG. 8 is a perspective view of a third embodiment of the waterproof seal with the second ends of both cords exiting at the sides of the seal.

FIG. 8 shows the third embodiment of the invention 200 being applied to seal the neck of a drysuit 216. The third embodiment is provided to show alternative entry and exit points for the first cord 240 and the second cord 242. positioning The seal is comprised of an upper portion 212, and a lower portion 214. The upper portion 212 can be made using neoprene or any waterproof material with stretchable characteristics. The lower portion 214 can be made using any waterproof material or fabric. A waterproof seal 228 is used to connect the upper portion 212 to the lower portion 214 and to connect the lower portion 214 to the suit 216.

The upper portion of the seal 212 is comprised of an inner layer 248 and an outer layer 250, which are made when a stretchable waterproof material is folded over to create a cavity 238. Attached to the upper portion 212, are one central major buckle 230 and two minor buckles 232 located on either side. The major buckle 230 has two cord ports and the minor buckles 232 each have one port. The buckles are tethered to the seal using a buckle tether 234.

In this embodiment, the exit location of first cord 240's first end 220 is still located more than 180 degrees, but less than 360 degrees away from the exit location of first cord 240's second end 222. Similarly, second cord 242's first end 224 exits cavity 238 at a location that is over 180 degrees, but less than 360 degrees away from the exit location of second cord 242's second end 226. The difference between cord exits is roughly 270 degrees about the centre of the circular seal. This creates a cord overlap location 244. Because the cords are overlapping, there is now tension around the full circumference of the seal.

Figure 9:
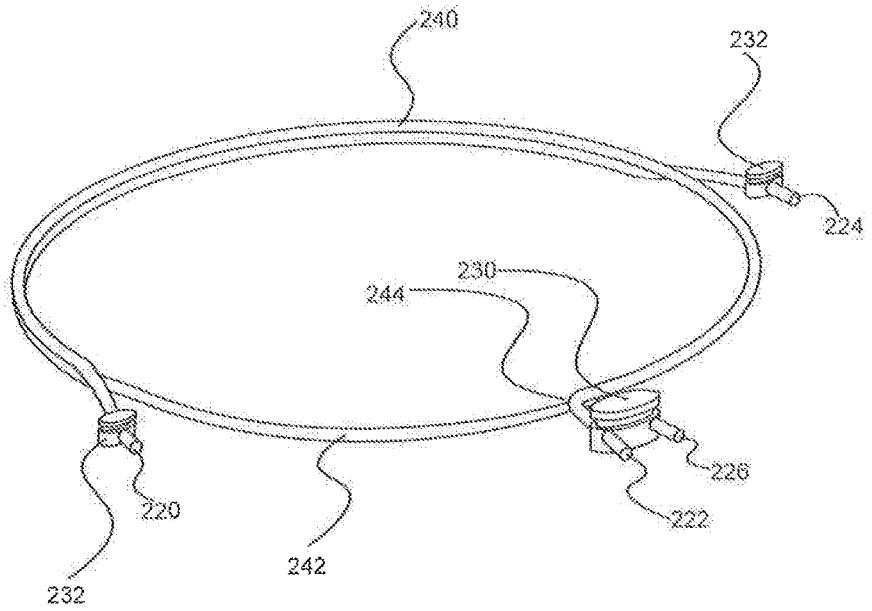
FIG. 9 is a perspective view of the cords for the waterproof seal of FIG. 8.

FIG. 9 shows the cord routing of the third embodiment 200 with the upper portion 212, and the lower portion 214 removed. This provides a clear view of first cord 240 and second cord 242 and shows how tensioning of the seal can be achieved over 360 degrees. It also provides a clearer view of the overlap location 244.

Advantages:

The waterproof seal described above and it's variations serve as an alternative to the waterproof seal of Vidal. It should be noted that the waterproof seal of two cords provides some advantages over the waterproof seal of Vidal.

1. The waterproof seal described above allows for preadjustment of the neck seal. Someone with a small neck can preadjust the length of one of the two cords. With this preadjustment, to get a waterproof seal they only have to pull the remaining cord a small amount, making it faster to activate.

2. If the cord breaks in the waterproof seal of Vidal, the seal ceases function. If one of the cords breaks in the waterproof seal described above, the other cord will still provide some sealing function. This seal that may let a small amount of water in, but is better than no seal.

3. With the single cord of more than 360 degrees length of cord, as taught by Vidal, the 360 degree cord overlaps itself and the overlapped cord section is more prone to wear than is the waterproof seal described above.

4. The waterproof seal described above, when fully tensioned, has less excess cord hanging from the seal, as compared to Vidal. Excess cord hanging from the seal can be an inconvenience as it can tangle, catch on things, or hit the wearer in the face.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A waterproof seal for drysuits, comprising:

a flexible annular tube formed by an inner layer and an outer layer of a garment and surrounding a passage through which a human appendage is intended to protrude;

a first cord positioned in a cavity defined by the annular tube, the first cord having a first end and a second end, the first cord extending more than 180 degrees and less than 360 degrees around the passage with at least one of the first end and the second end exiting the annular tube;

a second cord positioned in the cavity defined by the annular tube, the second cord having a first end and a second end, the second cord extending more than 180 degrees and less than 360 degrees around the passage with at least one of the first end and the second end exiting the annular tube;

the first cord and the second cord cumulatively covering more than 360 degrees around the passage to provide an effective water seal;

a first cord retainer engaging the first cord in the vicinity of the first end and a second cord retainer engaging the first cord in the vicinity of the second end, at least one of the first cord retainer and the second cord retainer being capable of repositioning to a selected position along the first cord for the purpose of adjusting the length of the first cord; and a third cord retainer engaging the second cord in the vicinity of the first end and a fourth cord retainer engaging the second cord in the vicinity of the second end, at least one of the third cord retainer and the fourth cord retainer being capable of repositioning to a selected position along the second cord for the purpose of adjusting the length of the second cord.

2. The waterproof seal of claim 1, wherein the second cord retainer and the fourth cord retainer are housed in a single body.

3. The waterproof seal of claim 1, wherein at least one of the first cord or the second cord is made from an elastomeric material.

4. The waterproof seal of claim 1, wherein the inner layer and the outer layer are made from an elastomeric material.

5. The waterproof seal of claim 4, wherein the elastomeric material is neoprene.

6. The waterproof seal of claim 1, wherein an access port is provided into the cavity.

7. The waterproof seal of claim 1, wherein each of the first cord retainer, the second cord retainer, the third cord retainer and the fourth cord retainer are positioned exterior of the annular tube.

8. The waterproof seal of claim 1, wherein the second cord retainer and the fourth cord retainer are positioned exterior of the annular tube and the first cord retainer and the third cord retainer secured to an interior panel located within the cavity, such that the first cord retainer and the third cord retainer are hidden underneath the outer layer.

* * * * *